US009374879B2

(12) United States Patent
Kuroki et al.

(10) Patent No.: US 9,374,879 B2
(45) Date of Patent: Jun. 21, 2016

(54) X-RAY EQUIPMENT

(71) Applicants: Takahiro Kuroki, Nasushiobara (JP); Kenji Mizutani, Nasushiobara (JP); Seiichirou Nagai, Otawara (JP); Hiroaki Sato, Nasushiobara (JP)

(72) Inventors: Takahiro Kuroki, Nasushiobara (JP); Kenji Mizutani, Nasushiobara (JP); Seiichirou Nagai, Otawara (JP); Hiroaki Sato, Nasushiobara (JP)

(73) Assignees: Kabushiki Kaisha Toshiba, Tokyo (JP); Toshiba Medical Systems Corporation, Otawara-shi (JP)

( * ) Notice: Subject to any disclaimer, the term of this patent is extended or adjusted under 35 U.S.C. 154(b) by 443 days.

(21) Appl. No.: 13/717,081

(22) Filed: Dec. 17, 2012

(65) Prior Publication Data

US 2013/0163726 A1 Jun. 27, 2013

(30) Foreign Application Priority Data

Dec. 22, 2011 (JP) ..... 2011-281636

(51) Int. Cl.

| | |
|---|---|
| ***H05G 1/00*** | (2006.01) |
| ***H05G 1/24*** | (2006.01) |
| ***H05G 1/10*** | (2006.01) |
| ***H05G 1/58*** | (2006.01) |

(52) U.S. Cl.

CPC . *H05G 1/24* (2013.01); *H05G 1/10* (2013.01); *H05G 1/58* (2013.01)

(58) Field of Classification Search

None

See application file for complete search history.

(56) References Cited

U.S. PATENT DOCUMENTS

2004/0007990 A1 1/2004 Kitaoka
2011/0249800 A1* 10/2011 Sung ..... A61B 6/56 378/103

FOREIGN PATENT DOCUMENTS

| | | | |
|---|---|---|---|
| CN | 102238913 A | | 11/2011 |
| JP | 64-082496 | | 3/1989 |
| JP | 05082287 A | * | 4/1993 |
| JP | 05-073900 U | | 10/1993 |
| JP | 2004-031024 A | | 1/2004 |

(Continued)

OTHER PUBLICATIONS

Combined Chinese Office Action and Search Report issued Jun. 26, 2014 in Patent Application No. 201210559737.8 (with English translation of categories of cited documents).

(Continued)

*Primary Examiner* — Andrew Smyth

(74) *Attorney, Agent, or Firm* — Oblon, McClelland, Maier & Neustadt, L.L.P

(57) ABSTRACT

The X-ray equipment related to the embodiment is configured from a plurality of pressure rising units, a switching unit, and a switching control unit. The plurality of pressure rising units are connected to the battery unit and generate direct current voltage. The switching unit switches over the plurality of pressure rising units and supplies direct current voltage to the X-ray generating unit. The switching control unit transmits switching instructions to the switching unit for switching over the pressure rising unit after receiving voltage supply instructions with respect to the X-ray generating unit until said voltage supply instructions terminate. The switching control unit controls discharging of the condenser inside the pressure rising unit switched over by the switching instructions and the control of commencing charging of the condenser inside the pressure rising unit following termination of discharging.

6 Claims, 15 Drawing Sheets

(56) References Cited

FOREIGN PATENT DOCUMENTS

| | | | | |
|---|---|---|---|---|
| JP | 2005-184917 | A | | 7/2005 |
| JP | 2006-141777 | | | 6/2006 |
| JP | 2006141777 | A | * | 6/2006 |
| JP | 2006-344445 | A | | 12/2006 |
| JP | 2010-273827 | | | 12/2010 |
| KR | 10-2008-0084483 | A | | 9/2008 |
| KR | 20080084483 | A | * | 9/2008 |
| WO | WO2010/041859 | A | | 4/2010 |

OTHER PUBLICATIONS

Japanese Office Action dated Jun. 23, 2015 for Japanese Patent Application No. 2011-281636.

* cited by examiner

X-RAY EQUIPMENT

CROSS-REFERENCE TO RELATED APPLICATION

This application is based upon and claims the benefit of priority from Japanese Patent Application No. 2011-281636, filed Dec. 22, 2011; the entire contents of which are incorporated herein by reference.

FIELD

The embodiment of this invention relates to X-ray equipment.

BACKGROUND

X-ray equipment is machinery used to detect X-rays which have penetrated a subject and image the inside of said subject. For example, X-ray equipment equipped with equipments for X-ray photography comprising an X-ray tube for X-ray irradiation along with a battery that supplies electricity necessary for X-ray photography and runs the carriage in a movable carriage, so-called X-ray equipment for consultation, is known as one type of said X-ray equipment.

Said X-ray equipment for consultation is configured from: an electric power conditioner that converts the battery to alternating-current voltage comprising a specific voltage and frequency, a high voltage generating unit that increases the voltage and carries out rectification with respect to said alternating-current voltage in addition to generating high voltage direct current, and an X-ray controller that controls the voltage and application time of the high voltage direct current.

An inverter type high voltage generating device, which increases the frequency of the primary voltage supplied to the high voltage transformer from several kHz to several tens of kHz and generates high voltage, is spread as said high voltage generating unit.

The inverter type high voltage generating device used for said X-ray equipment for consultation is provided with a high pressure condenser on the high-pressure side of the high voltage transformer with the battery as a power source and the electrical charge accumulated in said high pressure condenser is discharged, thereby supplying (applying) high voltage to the X-ray tube.

Incidentally, so-called penetrative photography is known, which accumulates a plurality of consecutive X-ray images in a short period of time; however, high-speed serial radiography is necessary in said penetrative photography. The same may be considered regarding said X-ray equipment for consultation.

However, according to said conventional technique, discharging and charging of the high pressure condenser is alternately carried out for all radiography and radiography cannot be carried out when the high pressure condenser is being charged; therefore, serial radiography cannot be carried out at high speeds. Accordingly, penetrative photography, etc., in which high-speed serial radiography is the precondition thereof, cannot be carried out using said conventional technique.

DETAILED DESCRIPTION

The problem to be solved by the present invention is to provide X-ray equipment allowing for high-speed serial radiography in an environment in which a commercial power supply cannot be used.

The X-ray equipment of the embodiment is configured from a plurality of pressure rising units, a switching unit, and a switching control unit. The plurality of pressure rising units are connected to a battery unit and generate direct current voltage. The switching unit switches over a plurality of pressure rising units and supplies direct current voltage to the X-ray generating unit. The switching control unit transmits switching instructions to the switching unit for switching over the pressure rising unit after receiving voltage supply instructions with respect to the X-ray generating unit until said voltage supply instructions terminate. The switching control unit carries out control of discharging the condenser inside the pressure rising unit switched over by the switching instructions and control of commencing charging of the condenser inside the pressure rising unit following termination of discharging.

Embodiment 1

Embodiment 1 of the X-ray equipment is described as follows with reference to the diagrams.

[Overall Structure]

Figure 1:
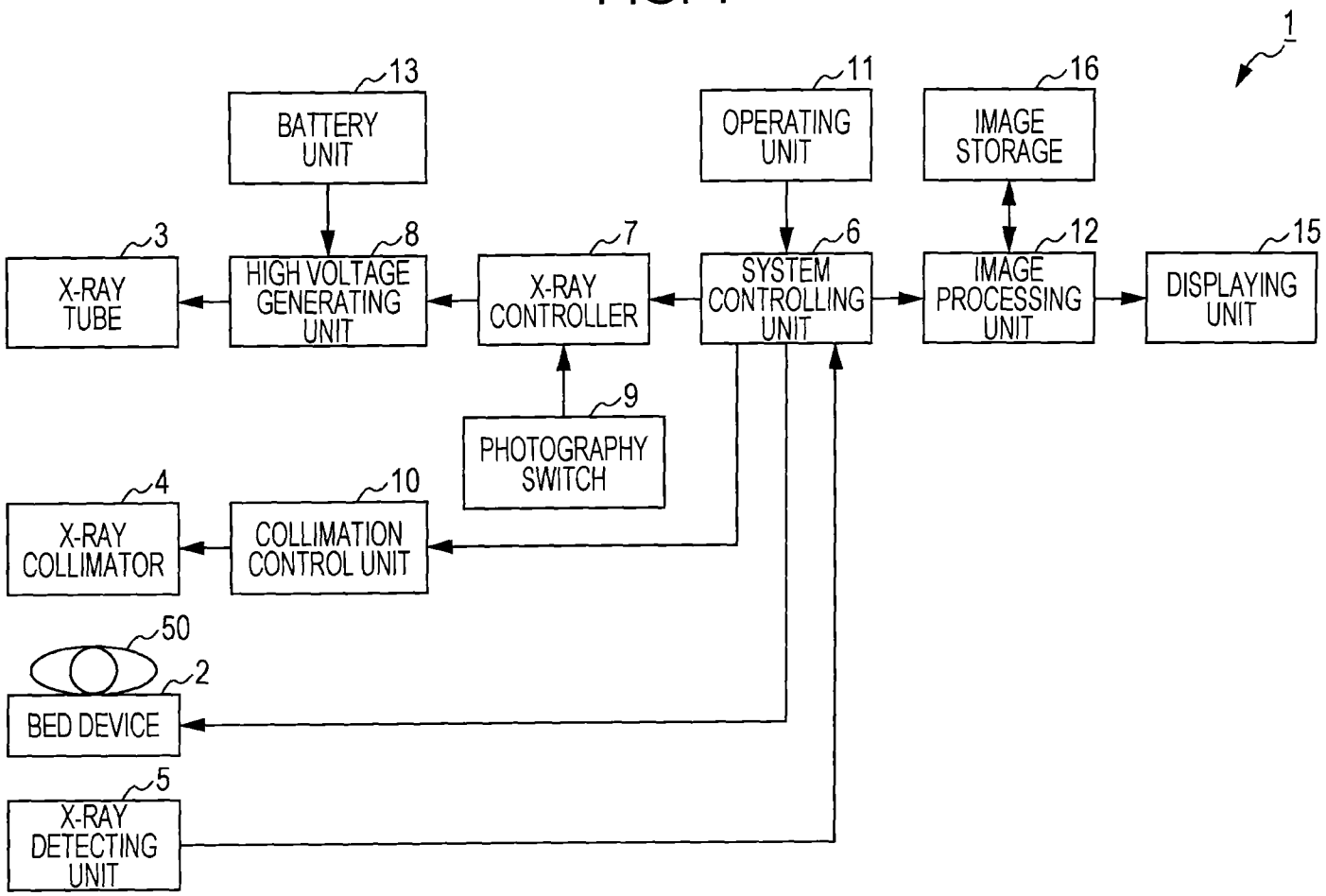
FIG. 1 is a schematic block diagram showing a configuration example of the X-ray equipment of Embodiment 1.

A configuration example of X-ray equipment 1 related to the present embodiment is shown in FIG. 1.

The X-ray equipment 1 is configured from an X-ray tube 3, a system controlling unit 6, an X-ray controller 7, a high voltage generating unit 8, a photography switch 9, an operating unit 11, an image processing unit 12, and a battery unit 13.

Each part of the X-ray equipment 1 is controlled by the system controlling unit 6 via the operating unit 11 based on content input with information. Furthermore, the actual X-ray equipment 1 contains configurations other than those shown in FIG. 1, and the system controlling unit 6 controls said configurations as well.

A subject 50 is placed on a bed device 2. The X-ray tube 3 accelerates electrons emitted from a cathode using high voltage and caused to collide with an anode, thereby generating X-rays. The high voltage generating unit 8 generates high voltage direct current in order to accelerate the electrons emitted from the cathode in addition to supplying (applying) said high voltage direct current to the X-ray tube 3.

Figure 2:
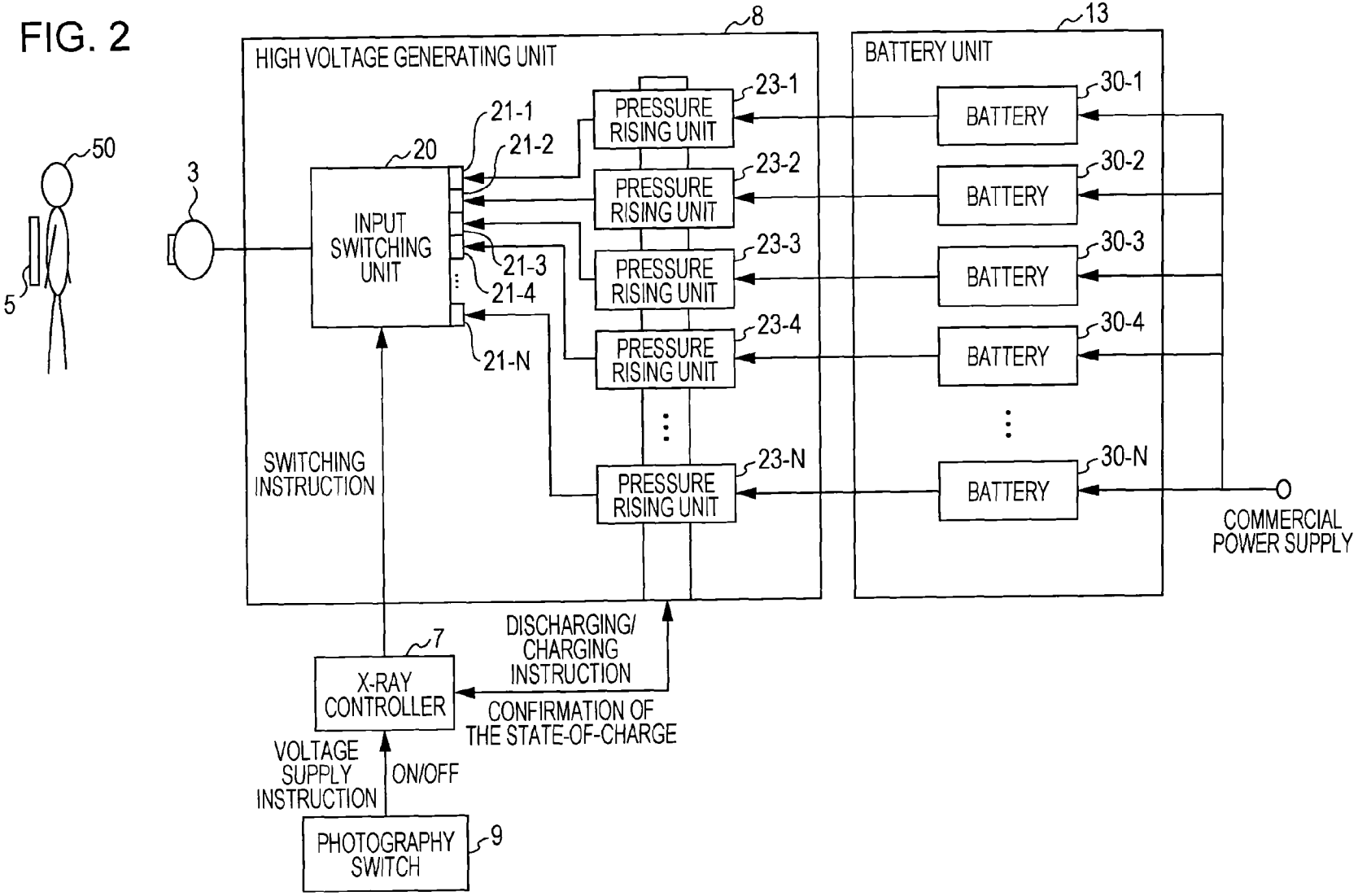
FIG. 2 is a block diagram mainly showing an example of the high voltage generating unit in Embodiment 1.

The battery unit 13 is, as shown in FIG. 2, configured from a plurality of batteries 30-1 to 30-N (N is an integer of 2 or more) and comprises a function of supplying high voltage direct current to a plurality of pressure rising units 23-1 to 23-N, described later, which configure the high voltage generating unit 8.

The X-ray controller 7 controls the timing of supplying (applying) the high voltage direct current to the X-ray tube 3, controls the pulse width (radiography time, msec) of the X-ray output from the X-ray tube 3, controls switching of the input switching unit 20 (refer to FIG. 2) configuring the high voltage generating unit 8 described later, etc. Moreover, the X-ray controller 7 is connected to the photography switch 9, which inputs a trigger instructing the commencement and termination of X-ray photography. Furthermore, the user inputs the trigger to the photography switch 9.

An X-ray collimator 4 specifies the irradiation range of the X-rays. The X-ray collimator 4 is provided with a plurality of collimating wings. A collimation control unit 10 shifts said collimating wings. Thereby, the X-ray irradiation range of the X-ray collimator 4 is changed. The X-rays passing through the X-ray collimator 4 are irradiated onto the subject 50.

The X-ray equipment 1 comprises a support construction (not illustrated) supporting the X-ray tube 2 and X-ray collimator 3 such that they may be integrally shifted. Said support construction may be shifted along, for example, a rail installed on the ceiling of a laboratory, and is an arm that may be vertically expanded and contracted. Moreover, when a stand for photographing in a standing position is used instead of the bed device 2, with respect to the X-ray detecting unit provided in said stand, a support construction is used that supports the X-ray tube 2 and X-ray collimator 3 such that they may be horizontally shifted. The shifting of the X-ray tube 3 and X-ray collimator 4 according to said support construction may be manually carried out by the user or may be electrically driven by configuring such that an actuator installed in the support construction is controlled by a system controlling unit 6. Moreover, a similar configuration may be applied to movably configure the X-ray detecting unit 5.

The X-ray detecting unit 5 comprises a detector that detects the X-rays passing through the subject 50. As the detector thereof, for example, a flat panel detector (FPD), an image intensifier (I.I.), an imaging plate (IP), etc., are used. The X-ray detecting unit 5 detects X-rays, converts these into electrical signals, and transmits them to the system controlling unit 6. The system controlling unit 6 transmits said electrical signals to the image processing unit 12.

The image processing unit 12 carries out various processes on the electrical signals from the system controlling unit 6. Said processes includes displaying processes such as a look-up table conversion process, window level adjustment, window width adjustment, etc. The image data generated by said displaying processes is transmitted to a displaying unit 15. The displaying unit 15 displays images based on said image data. Moreover, the image data generated by the image processing unit 12 is stored in image storage 16.

[High Voltage Generating Unit]

Figure 3:
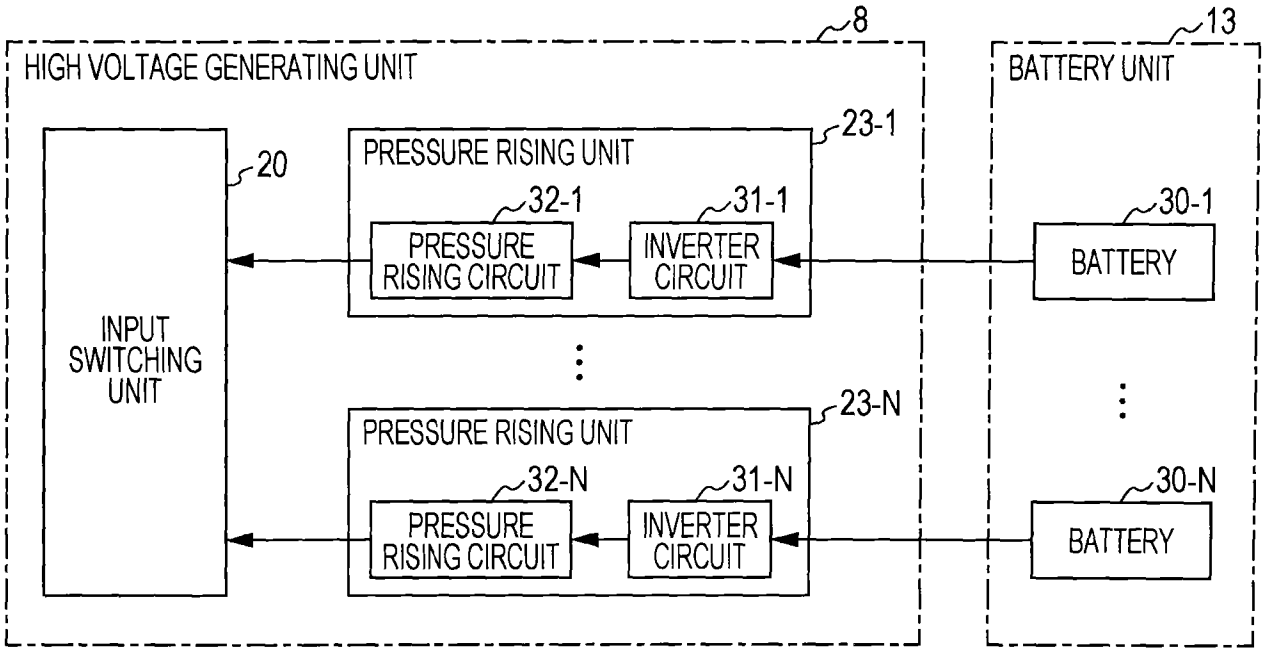
FIG. 3 is a block diagram showing an example of the configuration of the pressure rising unit.

The configuration and action of the high voltage generating unit 8 related to the present embodiment is described in detail in the following. FIG. 2 shows an example of the configuration of mainly the high voltage generating unit 8 of the present embodiment. FIG. 3 is a diagram showing an example of the configuration of the pressure rising unit 23-1 to 23-N (N is an integer of 2 or more).

The high voltage generating unit 8 is, as shown in FIG. 2, provided with the plurality of pressure rising units 23-1 to 23-N that applies high voltage direct current. The pressure rising units 23-1 to 23-N are respectively connected to batteries 30-1 to 30-N.

The pressure rising units 23-1 to 23-N are, as shown in FIG. 3, respectively configured from inverter circuits (electric power conditioners) 31-1 to 31 to N (N is an integer of 2 or more) and pressure rising circuits (area with increased pressure) 32-1 to 32 to N (N is an integer of 2 or more).

Each inverter circuit 31-1 to 31 to N is, for example, configured by electrical transistors Tr1 and Tr2 (both not illustrated) and electrical transistors Tr3 and Tr4 (both not illustrated) connected in series and connected in parallel to a battery terminal, in which a load L (not illustrated) is provided between the connection between Tr1 and Tr2 as well as the connection between Tr3 and Tr4.

Each inverter circuit 31-1 to 31 to N converts the high voltage direct current supplied from the corresponding batteries 30-1 to 30-N to the alternating-current voltage comprising a specified frequency. Specifically, the Tr1 and Tr4 as well as the Tr2 and Tr3 are alternately switched in a specified cycle T1, thereby generating an alternating-current voltage comprising a frequency f1 (f1=1/T1) on both sides of the load L.

Each pressure rising circuit 32-1 to 32 to N is configured from a high voltage transformer (not illustrated), a high voltage rectifier, and a high pressure condenser. Each pressure rising circuit 32-1 to 32 to N increases the voltage and carries out rectification with respect to the alternating-current voltage of frequency f1 generated in the corresponding inverter circuit 31-1 to 31 to N and generates high voltage direct current. Specifically, the high voltage transformer increases the alternating-current voltage of the frequency f1 supplied from the corresponding inverter circuit, while the high voltage rectifier rectifies the alternating-current voltage increased by the high voltage transformer. Thereby, the high voltage direct current is generated and said high voltage direct current is accumulated in the high pressure condenser.

The high voltage direct current accumulated in the high pressure condenser is discharged by discharging instructions (X-ray photography instructions) from the X-ray controller 7 and transmitted to the input switching unit 20 mentioned later. The input switching unit 20 comprises input switches 21-1 to 21-N and supplies the high voltage direct current output from each pressure rising circuit 32-1 to 32 to N to the X-ray tube 3.

Each of said input switches 21-1 to 21-N is a so-called semiconductor switch and by means of switching on the semiconductor switch at a timing in which the high voltage direct current is supplied, the high voltage direct current generated inside the pressure rising units 23-1 to 23-N is input and supplied to the X-ray tube 3. Said timing for supplying the high voltage direct current is the starting of an irradiation timing pulse comprising a pulse width corresponding to the specified X-ray irradiation time. Supplying of the high voltage direct current is commenced at the starting of said irradiation timing pulse and supplying is stopped at termination.

Said semiconductor switch is configured using, for example, an insulated gate bipolar transistor (IGBT), a MOSFET (Metal Oxide Semiconductor-Field Effect Transistor), etc., but is not limited to this.

Operation Example of Switching Control

Figure 4:
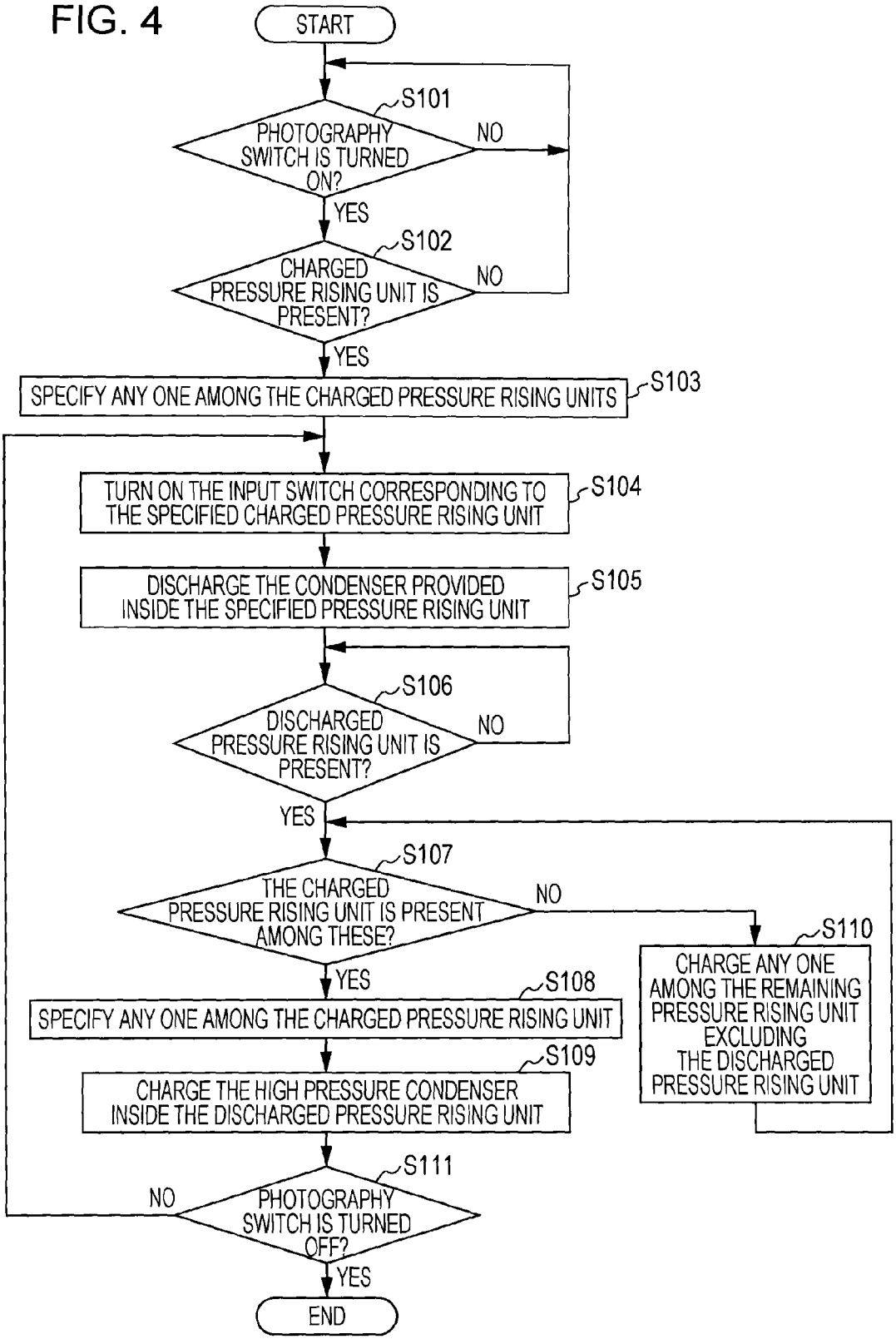
FIG. 4 is a flow chart describing the processing of the switching control of the X-ray controller.

The process of switching control with respect to the input switching unit 20 is described in detail in the following with reference to FIGS. 4 to 13. FIG. 4 is a flow chart describing the process of switching control of the X-ray controller 7. FIGS. 5 to 13 are schematic diagrams showing the switching state of the pressure rising units 23-1 to 23-N and the discharging/state-of-charge at each processing step of switching control of the X-ray controller 7.

Furthermore, in FIGS. 5 to 13, a black input switch indicates that the switch is turned on, meaning that the pressure rising unit corresponding to said black input switch is being specified. Moreover, a pressure increasing unit expressed by dot on whole area means that the high pressure condenser inside is charged, a white pressure increasing unit means that the high pressure condenser is discharged, and a pressure increasing unit expressed by dot and white means that the high pressure condenser is charging. This is the same regarding descriptions hereinafter.

Moreover, in the present embodiment, the content of high pressure condensers configuring each pressure rising circuit 32-1 to 32 to N are the same, and the electrical charge accumulated in the charged high pressure condenser are all discharged from one X-ray photography process. Furthermore, for example, one high pressure condenser comprising content corresponding to two X-ray photography processes may be used and said two X-ray photography processes may be carried out by distributing said one high pressure condenser into two discharges.

Moreover, the electricity necessary for charging each battery 30-1 to 30-N is supplied via a commercial power supply. After each battery 30-1 to 30-N has been charged, said commercial power supply is detached from each battery 30-1 to 30-N.

Moreover, the present embodiment is described on the assumption that all batteries 30-1 to 30-N are charged (fully charged) in advance. Furthermore, cases are described later wherein, when at least one among the batteries 30-1 to 30-N is not charged at all and cases in which although the batteries are charged, the charging is to a degree in which charging necessary for discharging during X-ray photography cannot be supplied.

(First X-Ray Photography Process)

First, the X-ray controller 7 determines whether or not the photography switch 9 is turned on (Step S101). If it is determined that the photography switch 9 is turned on (Yes at Step S101), the X-ray controller 7 confirms the state-of-charge of each pressure rising unit 23-1 to 23-N, and determines whether or not a charged pressure rising unit is present (Step S102). Here, confirmation of the state-of-charge is carried out by detecting the content of the high pressure condenser inside the pressure rising unit. Here, the charged pressure rising unit refers to a fully charged pressure rising unit.

Figure 5:
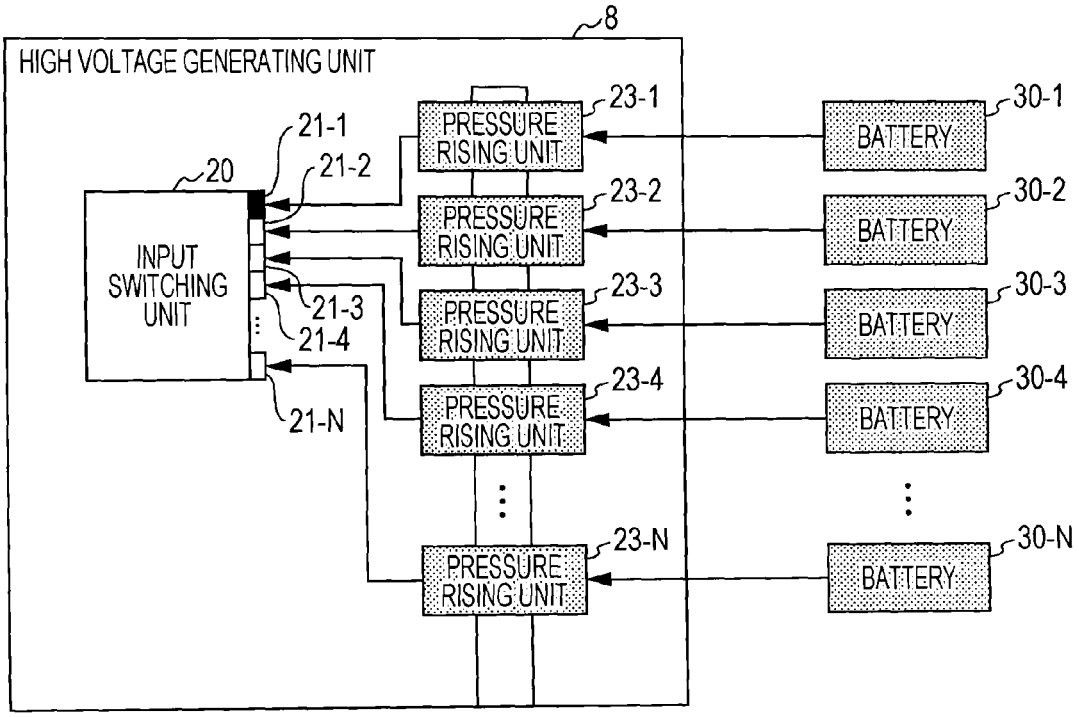
FIG. 5 is a schematic diagram describing an operation example of the X-ray equipment of Embodiment 1.

If at least one among the pressure rising units 23-1 to 23-N is charged, it is determined that the charged pressure rising unit is present (Yes at Step S102). When there is a plurality of charged pressure rising units, the input switching unit 20 specifies any one among said charged pressure rising units (Step S103). Said specification is carried out by switching instructions from the X-ray controller 7 to the input switching unit 20, and fundamentally, is specified in the order of the pressure rising units 23-1 to 23-N. In the example of FIG. 5, all among each pressure rising unit 23-1 to 23-N is charged, so it is determined that the charged pressure rising unit is present, and the input switching unit 20 first specifies the pressure rising unit 23-1.

Next, the X-ray controller 7 turns on the input switch corresponding to the specified charged pressure rising unit (Step S104). In the example of FIG. 5, the input switch 21-1 corresponding to the specified pressure rising unit 23-1 is turned on. Furthermore, the state in which the inside of the border of the input switch 21-1 is painted over with black means that the input switch 21-1 is turned on. This is the same regarding descriptions hereinafter.

Figure 6:
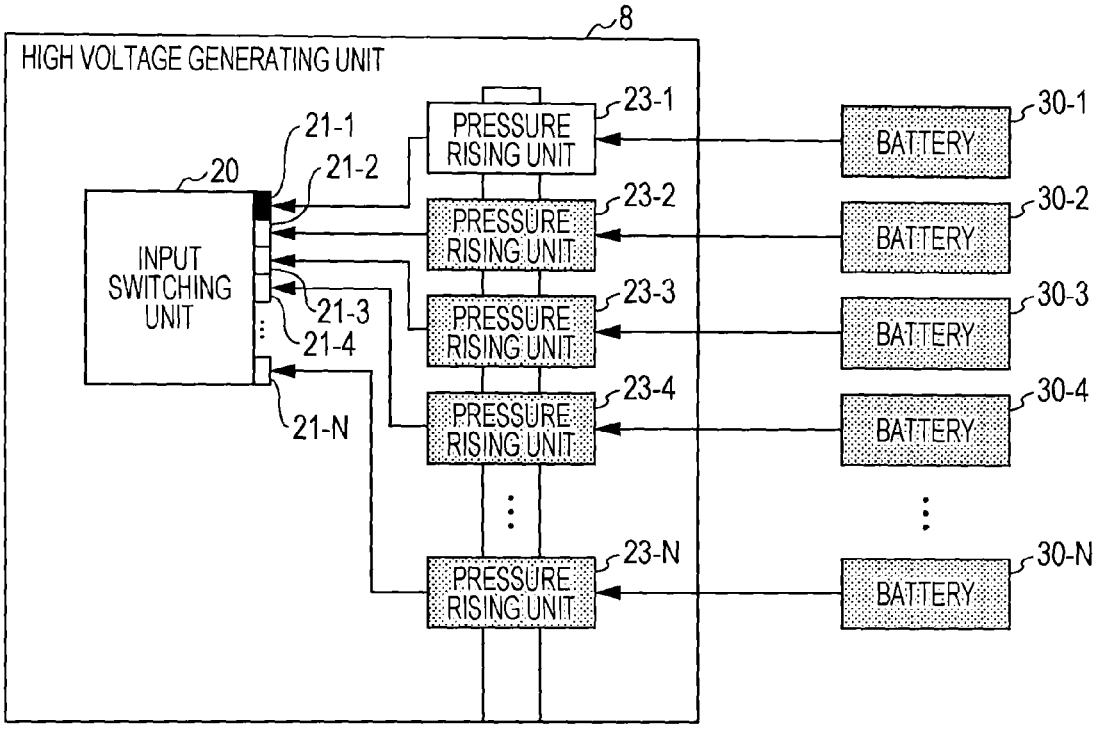
FIG. 6 is a schematic diagram describing an operation example of the X-ray equipment of Embodiment 1.
Figure 7:
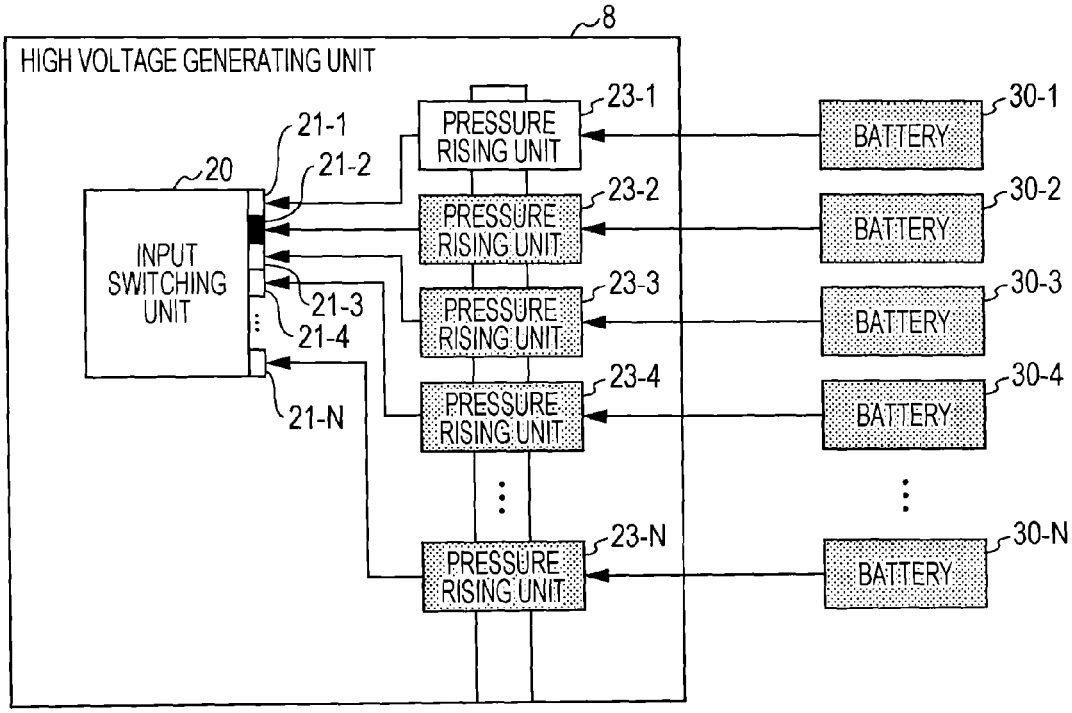
FIG. 7 is a schematic diagram describing an operation example of the X-ray equipment of Embodiment 1.

By means of switching on the input switch 21-1, it is switched over to the specified charged pressure rising unit 23-1. Said switching control is carried out by transmitting the switching instructions from the X-ray controller 7 to the input switching unit 20. Next, the X-ray controller 7 discharges the high pressure condenser provided inside said specified pressure rising unit (Step S105: refer to FIG. 6). In the example of FIG. 6, the X-ray controller 7 is discharging the high pressure condenser inside the pressure rising circuit 32-1 with respect to the specified pressure rising unit 23-1. Said discharging is carried out by transmitting discharging instructions from the X-ray controller 7 to the pressure rising unit 23-1. Furthermore, the switching instructions and the discharging instructions are generally transmitted at the same time.

Due to discharging of the high pressure condenser, the high voltage direct current generated inside the pressure rising unit 23-1 is supplied to the X-ray tube 3 at an irradiation time determined in advance. The first X-ray photography is completed when the specified irradiation time determined in advance passes after the high voltage direct current supply to the X-ray tube 3 is commenced.

Next, the X-ray controller 7 determines whether or not the discharged pressure rising unit is present (Step S106). When the discharged pressure rising unit is not present (No at Step S106), it returns to the determination process of Step S106. For example, when the pressure rising unit 23-1 that commenced discharging is still discharging, it is determined that the discharged pressure rising unit is not present; therefore, the state-of-discharge of the pressure rising unit 23-1 is continuously observed until discharging of the specified pressure rising unit 23-1 is completed.

Meanwhile, when it has been determined that the discharged pressure rising unit is present, the X-ray controller 7 confirms the state-of-charge of the remaining pressure rising unit excluding said discharged pressure rising unit, and determines whether or not the charged pressure rising unit is present among these (Step S107).

In the example of FIG. 6, discharging of the pressure rising unit 23-1 is completed and it is determined that the discharged pressure rising unit 23-1 is present; therefore, the X-ray controller 7 confirms the state-of-charge of the remaining pressure rising unit 23-2 to 23-N excluding said discharged pressure rising unit 23-1, and determines whether or not the charged pressure rising unit is present among these.

If at least one among said remaining pressure rising units is charged, it is determined that the charged pressure rising unit is present (Yes at Step S107). When it is determined that the charged pressure rising unit is present, the input switching unit 20 specifies any one among said charged pressure rising unit as the pressure rising unit to be discharged next (the second) (Step S108). Said specification is carried out by the switching instructions from the X-ray controller 7 to the input switching unit 20 in the same manner as the above.

In the example of FIG. 6, all the remaining pressure rising units 23-2 to 23-N are charged, so it is determined that the charged pressure rising unit is present at Step S107. Then, the input switching unit 20 specifies the pressure rising unit 23-2 to be discharged next (the second) from among said charged pressure rising units 23-2 to 23-N (refer to FIG. 7).

Here, the X-ray controller 7 specifies the pressure rising unit to be secondarily discharged while simultaneously commencing charging of the high pressure condenser inside the discharged pressure rising unit in which discharging was completed earlier (Step S109). Said charging is carried out by transmitting charging instructions from the X-ray controller 7 to the discharged pressure rising unit.

Figure 8:
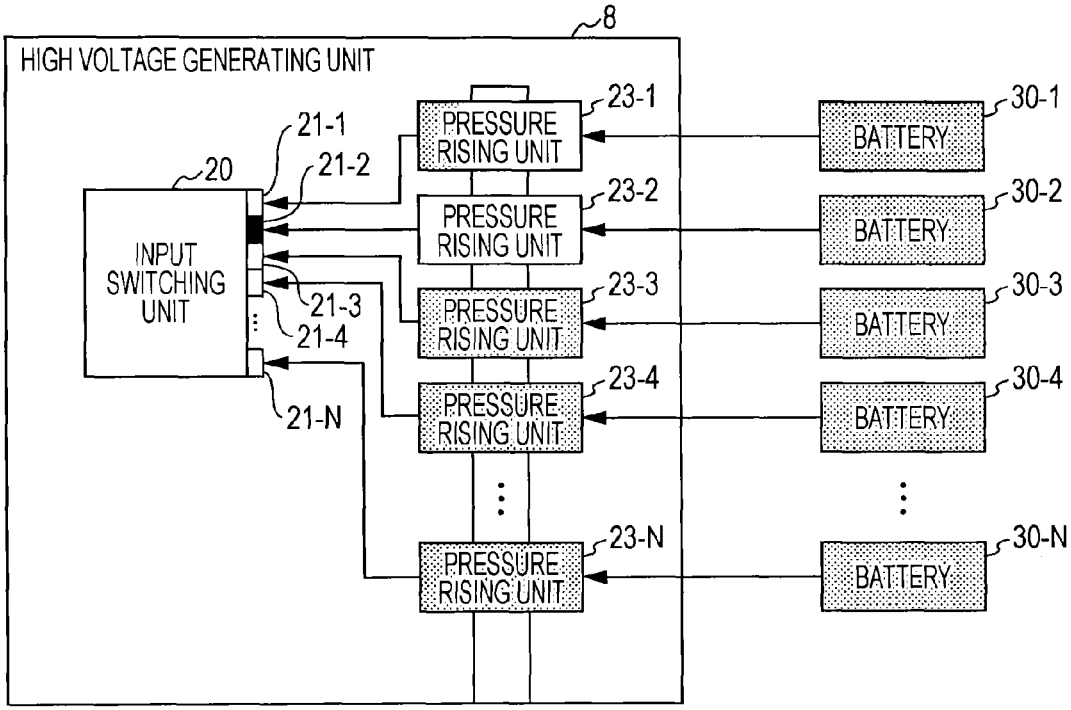
FIG. 8 is a schematic diagram describing an operation example of the X-ray equipment of Embodiment 1.
Figure 9:
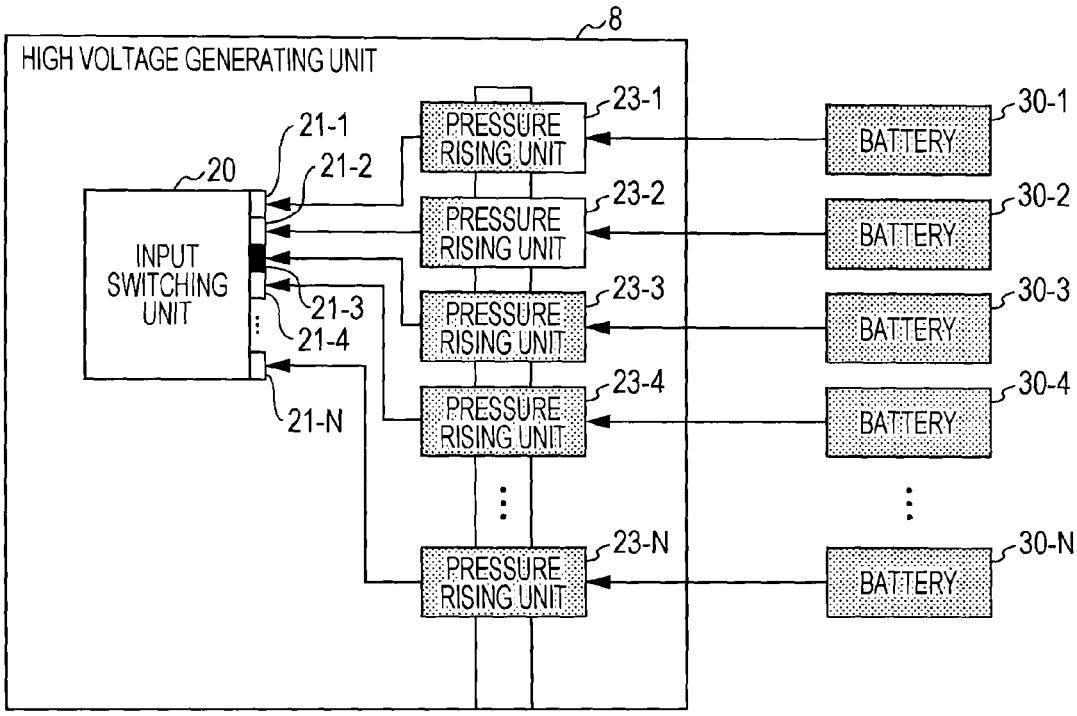
FIG. 9 is a schematic diagram describing an operation example of the X-ray equipment of Embodiment 1.

In the example of FIG. 8, charging of the high pressure condenser inside the discharged pressure rising unit 23-1 is commenced at the same time as specification of the pressure rising unit 23-2.

In the determination of Step S107, when it is determined that there is not a single charged pressure rising unit present in the remaining pressure rising unit excluding the discharged pressure rising unit (No at Step S107), the X-ray controller 7 commences charging with respect to the remaining pressure rising unit excluding the discharged pressure rising unit (Step S110). It returns to the determination process of Step S107 following commencement of charging, and the X-ray controller 7 observes the state-of-charge of all the pressure rising units 23-1 to 23-N until at least one among all the pressure rising units 23-1 to 23-N is charged.

In Step S108, once the pressure rising unit to be discharged next (the second) is specified, the X-ray controller 7 commences charging of the high pressure condenser inside the discharged pressure rising unit (Step S109) along with determining whether or not the photography switch 9 is turned off (Step S111).

In the example of FIG. 8, once the X-ray controller 7 specifies the pressure rising unit 23-2 to be discharged next, it charges the high pressure condenser inside the discharged pressure rising unit 23-1 while simultaneously determining whether or not the photography switch 9 is turned off.

If the photography switch 9 is turned on (No at Step S111), it returns to the process of Step S104. If the photography switch 9 is turned off (Yes at Step S111), the first X-ray photography process terminates. Regarding the process after returning to the process of Step S104, the next pressure rising unit to be specified is the same but otherwise, the fundamental process is the same. The second X-ray photography processes to the fourth X-ray photography processes are described in the following with reference to FIGS. 8 to 13.

(Second X-Ray Photography Process)

In the example of FIG. 8, if the photography switch 9 is turned on, the X-ray controller 7 turns on the input switch 21-2, which corresponds with the pressure rising unit 23-2, which is the next discharging subject specified at Step S108 (Step S104). Furthermore, the input switching instructions for turning on said input switch 21-2 and the charging instructions for commencing charging of the pressure rising unit 23-1 are generally transmitted at the same time.

By means of switching on the input switch 21-2, it is switched over to the specified charged pressure rising unit 23-2, while the output of the pressure rising unit 23-2 is input to the input switching unit 20 via the input switch 21-2.

Next, the X-ray controller 7 discharges the high pressure condenser provided inside the pressure rising circuit 32-2 configuring the specified pressure rising unit 23-2 (Step S105: refer to FIG. 8). Said discharging is carried out by transmitting discharging instructions from the X-ray controller 7 to the pressure rising unit 23-2. Furthermore, the switching instructions and the discharging instructions are generally transmitted at the same time.

Due to discharging of the high pressure condenser configuring the pressure rising unit 23-2, the high voltage direct current generated by the pressure rising unit 23-2 is supplied to the X-ray tube 3 at an irradiation time determined in advance. The second X-ray photography terminates when the specified irradiation time passes after supplying of the high voltage direct current to the X-ray tube 3 commences.

Next, the X-ray controller 7 determines whether or not the discharged pressure rising unit is present (Step S106). When the pressure rising unit 23-2 is still discharging (No at Step S106), it returns to the determination process of Step S106. That is, the state-of-discharge of the specified pressure rising unit 23-2 is continuously observed until discharging of the specified pressure rising unit 23-2 is completed.

Meanwhile, when discharging of the pressure rising unit 23-2 is completed (Yes at Step S106), the X-ray controller 7 confirms the state-of-charge of the remaining pressure rising units 23-1, 23-3 to 23-N excluding the discharged pressure rising unit 23-2, and determines whether or not the charged pressure rising unit is present among these (Step S107). If at least one among these is charged, it is determined that the charged pressure rising unit is present (Yes at Step S107). When determined that the charged pressure rising unit is present, the input switching unit 20 specifies any one among said charged pressure rising units as the pressure rising unit to be discharged next (the third) (Step S108). In the present case, the pressure rising unit 23-3 is determined as the third specified pressure rising unit (refer to FIG. 9).

Figure 10:
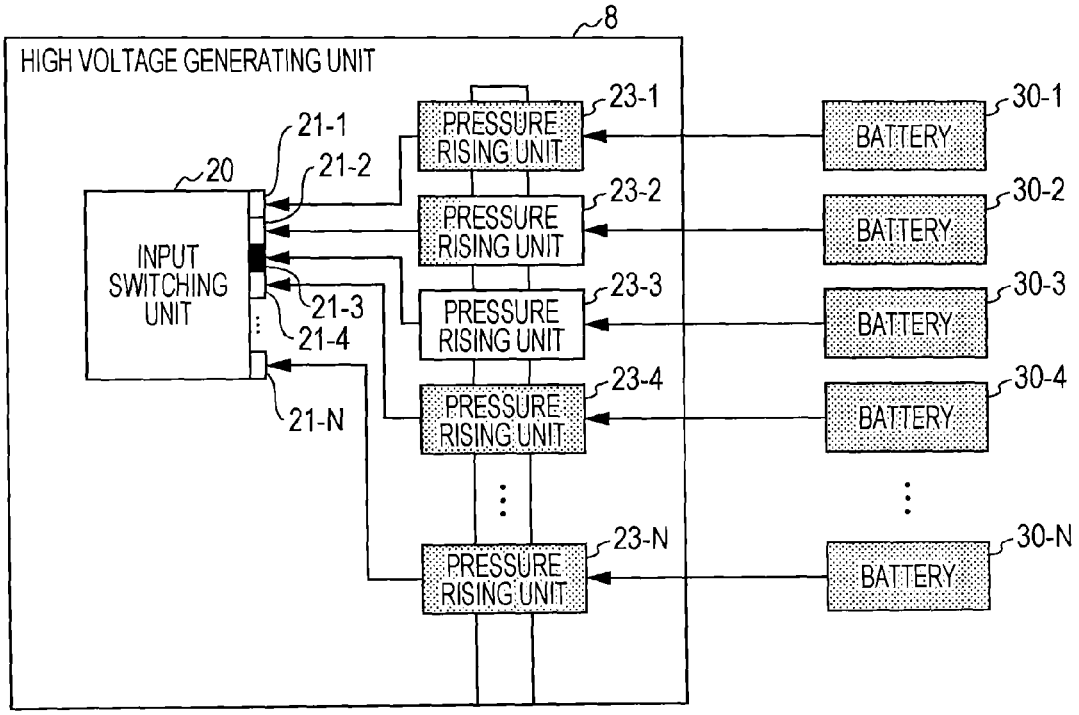
FIG. 10 is a schematic diagram describing an operation example of the X-ray equipment of Embodiment 1.
Figure 11:
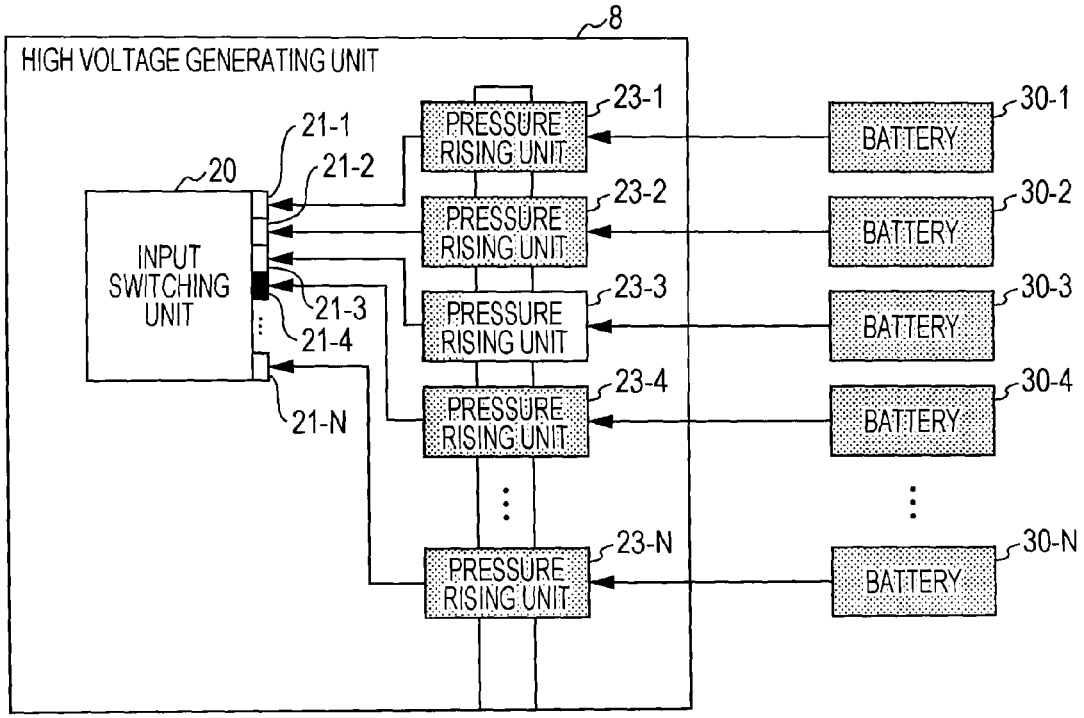
FIG. 11 is a schematic diagram describing an operation example of the X-ray equipment of Embodiment 1.

Next, the X-ray controller 7 commences charging of the high pressure condenser inside the discharged pressure rising unit 23-2 while simultaneously specifying the pressure rising unit 23-3 (Step S109: refer to FIG. 10). Furthermore, when the pressure rising unit 23-1 is still charging at this time, the charging process is also continued with respect to the pressure rising unit 23-1.

In the determination of Step S107, when it is determined that there is not a single charged pressure rising unit present in the remaining pressure rising units 23-1, 23-2, and 23-4 to 23-N excluding the discharged pressure rising unit 23-2 (No at Step S107), the X-ray controller 7 commences the charging process to at least one among the remaining pressure rising units 23-1, 23-2, and 23-4 to 23-N (Step S110). After commencing of said charging process, it returns to the determination process of Step S107, the state-of-charge of the pressure rising units 23-1, 23-2, and 23-N is observed, and when it is determined that at least one among these is charged, it proceeds to the pressure rising unit specifying process of Step S108.

Once the pressure rising unit 23-3 to be discharged next (the third) is specified at Step S108, the X-ray controller 7 charges the high pressure condenser inside the discharged pressure rising unit 23-2 (Step S109) along with determining whether or not the photography switch 9 is turned off (Step S111). Should the discharged pressure rising unit 23-1 still be charging at this time, the charging process of said pressure rising unit 23-1 is also continuously carried out (refer to FIG. 9).

When the photography switch 9 is turned on (No at Step S111), it returns to the process of Step S104. When the photography switch 9 is turned off (Yes at Step S111), the X-ray photography process is terminated.

(Third X-Ray Photography Process)

Here, when the photography switch 9 is turned on, the X-ray controller 7 turns on the input switch 21-3 corresponding to the pressure rising unit 23-3, which is the next subject to be discharged specified at Step S108. By means of turning on the input switch 21-3, it is switched over to the specified charged pressure rising unit 23-3, and the output of the pressure rising unit 23-3 is input to the input switching unit 20 via the input switch 21-3.

Next, the X-ray controller 7 discharges the high pressure condenser provided in the pressure rising circuit 32-3 configuring the specified pressure rising unit 23-3 (Step S105: refer to FIG. 10). By means of discharging the high pressure condenser configuring the pressure rising unit 23-3, the high voltage direct current generated inside the pressure rising unit 23-3 is supplied to the X-ray tube 3 at the irradiation time determined in advance. The third X-ray photography is completed when the specified irradiation time determined in advance passes after the high voltage direct current supply to the X-ray tube 3 is commenced.

Next, the X-ray controller 7 determines whether or not the discharged pressure rising unit is present (Step S106). Should the pressure rising unit 23-3 still be discharging (No at Step S106), it returns to the determination process of Step S106. That is, the state-of-discharge of the specified pressure rising unit 23-3 is continuously observed until discharging of the specified pressure rising unit 23-3 is completed.

Meanwhile, when discharging of the pressure rising unit 23-3 is completed (Yes at Step S106), the X-ray controller confirms the state-of-charge of the remaining pressure rising units 23-1, 23-2, and 23-4 to 23-N excluding the discharged pressure rising unit 23-3, and determines whether or not the charged pressure rising unit is present among these (Step S107). If at least one among these is charged, it is determined that the charged pressure rising unit is present (Yes at Step S107). When it is determined that the charged pressure rising unit is present, the input switching unit 20 specifies any one among said charged pressure rising units as the pressure rising unit to be discharged next (the fourth) (Step S108). In the present example, the pressure rising unit 23-4 is determined as the pressure rising unit to be specified fourth (refer to FIG. 11).

Figure 12:
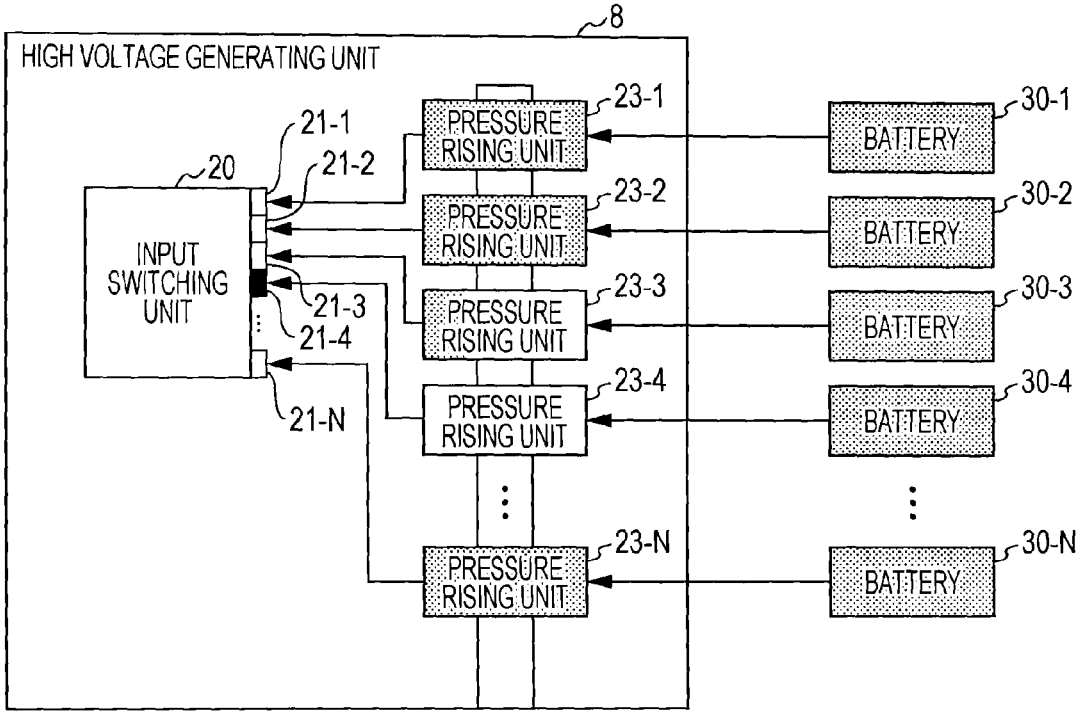
FIG. 12 is a schematic diagram describing an operation example of the X-ray equipment of Embodiment 1.
Figure 13:
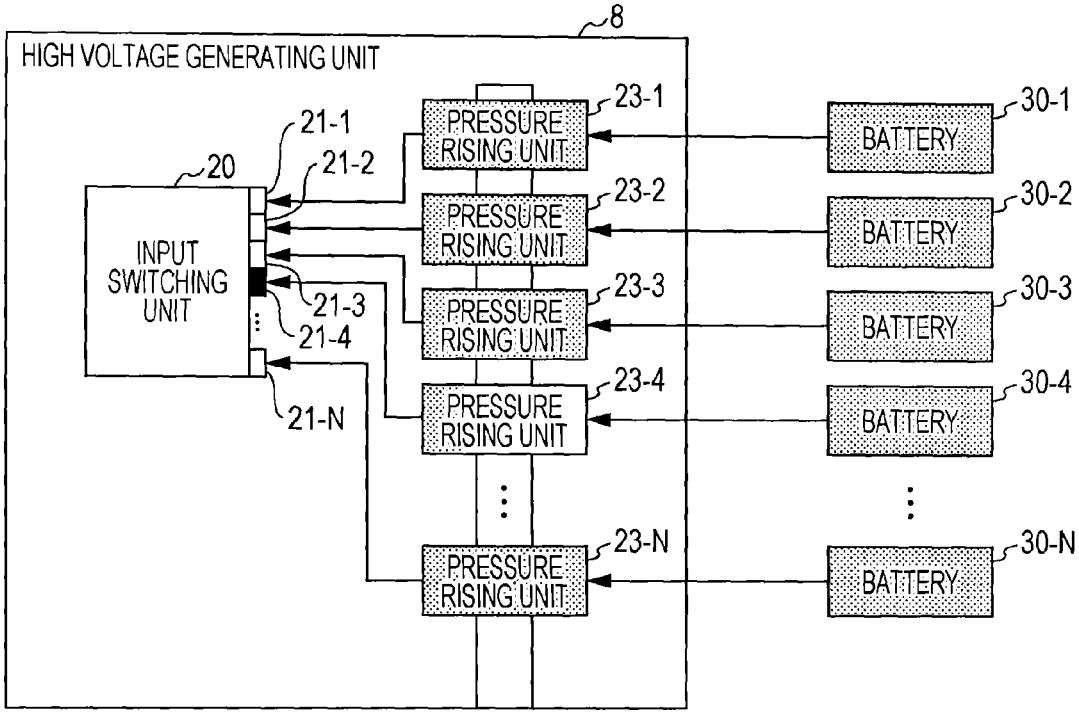
FIG. 13 is a schematic diagram describing an operation example of the X-ray equipment of Embodiment 1.

The X-ray controller 7 charges the high pressure condenser inside the discharged pressure rising unit 23-3 at the same time as specifying the pressure rising unit 23-4 (Step S109: refer to FIG. 12). Furthermore, should the pressure rising units 23-1 and 23-2 still be charging at this time, the charging process is also continued with respect to the pressure rising units 23-1 and 23-2.

In the determination of Step S107, when it is determined that there is not a single charged pressure rising unit present in the remaining pressure rising units 23-1, 23-2, and 23-4 to 23-N excluding the discharged pressure rising unit 23-3 (No at Step S107), the discharging process is commenced towards at least one among the remaining pressure rising units 23-1, 23-2, and 23-4 to 23-N (Step S110). Once commencing said discharging process, it returns to the determining process, the state-of-charge of the pressure rising units 23-1, 23-2, and 23-4 to 23-N is observed, and when it is determined that at least one among these is charged, it proceeds to the pressure rising unit specifying process of Step S108.

After the pressure rising unit 23-4 to be discharged (fourth) is specified at Step S108, the X-ray controller 7 commences charging of the high pressure condenser inside the discharged pressure rising unit 23-3 (Step S109) along with determining whether or not the photography switch 9 is turned off (Step S111). When the discharged pressure rising units 23-1 and 23-2 are still charging at this time, said charging process is continued. Furthermore, in the example of FIG. 11, the pressure rising units 23-1 are 23-2 are already charged.

When the photography switch 9 is turned off (No at Step S111), it returns to the process of Step S104. When the photography switch 9 is turned off (Yes at Step S111), the X-ray photography process is terminated (refer to FIG. 13).

(Fourth X-Ray Photography Process)

Here, when the photography switch 9 is turned on, the X-ray controller 7 turns on the input switch 21-4 corresponding to the pressure rising unit 23-4, which is the next subject for discharging specified at Step S108. By means of switching on the input switch 21-4, it is switched over to the specified charged pressure rising unit 23-4, and the output of the pressure rising unit 23-4 is input to the input switching unit 20 via the input switch 21-4.

Next, the X-ray controller 7 discharges the high pressure condenser provided in the pressure rising circuit 32-4 configuring the specified pressure rising unit 23-4 (Step S105: refer to FIG. 12). By means of discharging the high pressure condenser configuring the pressure rising unit 23-4, the high voltage direct current generated by the pressure rising unit 23-4 is supplied to the X-ray tube 3 at the irradiation time specified in advance. The fourth X-ray photography is completed when the specified irradiation time determined in advance passes after the high voltage direct current supply to the X-ray tube 3 is commenced.

Hereinafter, as long as the photography switch 9 is turned on (until the photography switch 9 is turned off), the processes from Step S104 to S111 are repeated.

In Embodiment 1, the pressure rising unit specified at Steps S103 and S108 is specified in sequence (ascending-order) of charged pressure rising units; however, it may be randomly specified as long as the condition is satisfied of specifying from inside the charged pressure rising unit.

Moreover, even when specifying in the sequence of pressure rising units, if the pressure rising unit to be discharged next is uncharged or if the corresponding battery is uncharged (empty) or if the content necessary for charging the high pressure condenser is not remaining, said uncharged, etc. pressure rising units may be skipped, and the pressure rising unit arranged after this may be specified.

In said embodiment 1, the pressure rising unit to be discharged was specified from inside the fully charged pressure rising unit such that the of X-ray radiation dose in the plurality of X-ray photography processes will be the same each time; however, for example, if X-ray photography is carried out at a different radiation dose at every process, discharging may be regulated such that the amount of charge is different per pressure rising unit. Furthermore, in order to increase the X-ray radiation dose during X-ray photography, the amount of charge charged to the condenser of the pressure rising unit must be increased.

Moreover, when the available battery temperature range is determined as in, for example, a lithium-ion battery or nickel-metal hydride battery, it may be controlled such that specification is only carried out when the battery is within said available temperature range.

Moreover, the X-ray controller 7 may change the output timing (photographing interval) of the high voltage direct current from the specified pressure rising unit according to each X-ray photography process. Thereby, there may be times in which X-ray photography must be carried out with various photographing intervals according to the photographing means; however, by carrying out control of changing the output timing (photographing interval) of the high voltage direct current at every photographing process, it may cope with any photographing process.

[Effect]

The X-ray equipment 1 related to Embodiment 1 described above is configured from the plurality of pressure rising units 23-1 to 23-N, the input switching unit 20, and the X-ray controller 5. The plurality of pressure rising units 23-1 to 23-N are connected to the battery unit 13, and generate the direct current voltage. The input switching unit 20 switches over the plurality of pressure rising units 23-1 to 23-N, and supplies direct current voltage to the X-ray tube 3.

The X-ray controller 5 transmits switching instructions for switching over the pressure rising unit to the input switching unit 20 after receiving instructions for supplying voltage (voltage supply instructions) to the X-ray tube 3 until said voltage supply instruction terminates. The X-ray controller 7 carries out control of discharging the condenser inside the pressure rising unit switched over by the switching instructions and control of commencing charging of the condenser inside the pressure rising unit following termination of discharging.

The input switching unit 20 receives switching instructions from the X-ray controller 7 and switches over the pressure rising unit. Then, discharging of the high pressure condenser inside the switched-over pressure rising unit is commenced, high voltage direct current is supplied to the X-ray tube 3, and charging of the condenser inside the discharged pressure rising unit is commenced.

Therefore, according to the X-ray equipment related to Embodiment 1, there is a plurality of pressure rising units supplying necessary high voltage direct current for X-ray photography, the pressure rising unit supplying voltage to the X-ray tube 3 is switched over and the high pressure condenser inside the pressure rising unit is discharged; consequently, since each process regarding said switching discharging is easy and finishes in a short period of time, the X-ray photography may be successively carried out with high speed. Accordingly, penetrative photography, etc., which is a precondition for high-speed serial radiography, cannot be carried out using said conventional technique.

Moreover, the discharged pressure rising circuit in which discharging of the switched-over pressure rising unit has terminated is being charged, so the state in which the pressure rising unit is empty will not be continued. Even if there is not a single charged pressure rising unit inside the remaining pressure rising unit excluding the discharged pressure rising unit, control is carried out for commencing charging regarding the remaining uncharged pressure rising unit (uncharged pressure rising unit).

Accordingly, even when X-ray photography is successively carried out at high speed, the X-ray photography will not be discontinued mid-way of the photography process.

Modified Example 1

In said Embodiment 1, an example was explained in which a plurality of pressure rising units 23-1 to 23-N were connected to the same number of batteries 30-1 to 30-N; however, it may be carried out such that the plurality of pressure rising units 23-1 to 23-N are connected to one battery.

In this case, the switching control of the pressure rising units 23-1 to 23-N itself is the same as the example mentioned above; however, when charging the discharged pressure rising unit, charging is carried out using electricity from said one battery regarding any pressure rising unit. In the modified example, all the pressure rising units may be charged using one battery, thereby having an effect of making the system configuration simpler.

Moreover, when the pressure rising units 23-1 to 23-N respectively connected to different batteries is the condition, said condition may be satisfied when the number of batteries is more than the number of pressure rising units in addition to when the number of batteries and the number of pressure rising units are the same, as in said Embodiment 1.

Meanwhile, it may be a mode in which one specific battery is shared among a plurality of pressure rising units (when the number of batteries is less than the number of pressure rising units). In this case, the battery to be shared among the plurality of pressure rising units must have the amount of charge necessary for discharging said pressure rising units.

Modified Example 2

In said Embodiment 1, the state-of-charge of the pressure rising unit to be discharged is always in a full state-of-charge. This is because the purpose thereof is an X-ray photography process carried out by irradiating X-rays of the same dose a plurality of times during a short period of time.

Incidentally, the photographing method (photographing means) that photographs two X-ray images under X-ray conditions with different radiation doses and separates images of soft tissues and bones by differentiating energy distribution, so-called energy subtraction photography, is known as X-ray photography.

In order to carry out said energy subtraction photography, as mentioned above, X-rays with different radiation dose must be successively irradiated within a short period of time; however, the control of said Embodiment 1 is such that X-rays of the same radiation dose are irradiated several times, making the carrying out of said energy subtraction photography difficult.

Thereupon, according to Modified Example 2, the amount of charge (level of increased voltage) provided to each pressure rising unit is deliberately differentiated, thereby allowing successive irradiation of X-rays with different radiation doses within a short time interval.

Figure 14:
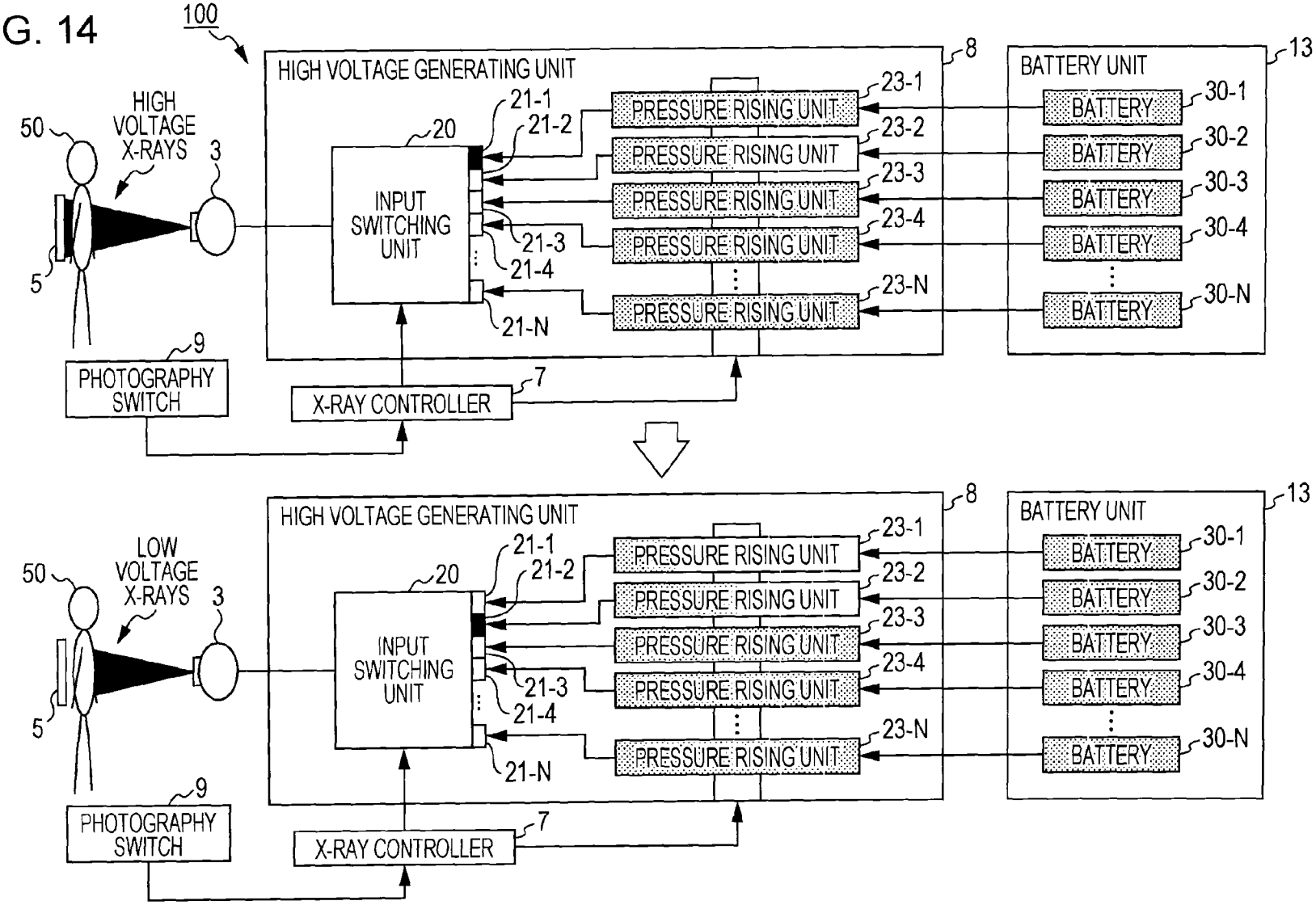
FIG. 14 is a schematic diagram showing a modified example of the X-ray equipment of Embodiment 1.

The configuration and action of the X-ray equipment 1 related to the present Modified Example 2 are described with reference to FIG. 14. FIG. 14 is a diagram describing the switching control when different levels of increased voltage are applied to each pressure rising unit and these are irradiated with X-rays with different radiation dose.

The configuration of the X-ray equipment 1 itself is the same as the X-ray equipment 1 related to Embodiment 1 and only the switching control and charging control in the X-ray controller 7 is different, a point which is mainly described in the following.

Operation Example of the Switching Control and Charging Control

In Modified Example 2, an example is described in which high voltage X-rays and low voltage X-rays are successively irradiated in order. Here, high voltage X-rays refers to X-rays generated by discharging a condenser comprising a relatively large amount of charge, while low voltage X-rays refers to X-rays generated by discharging a condenser comprising a relatively small amount of charge.

Regarding the amount of charge of the condenser necessary for generating the high voltage X-rays used in Modified Example 2, it has been determined that, for example, the amount of charge corresponding to about 100% of the full amount of charge (hereinafter referred to as the "full amount of charge") is necessary for the high pressure condenser, and regarding the amount of charge of the condenser necessary for generating low voltage X-rays, has been determined that, for example, the amount of charge corresponding to about 30% of the full amount of charge of the condenser (hereinafter, referred to as a "30% amount of charge") is necessary.

In the example from FIG. 14, at the stage in which the photography switch 9 is turned off, the pressure rising unit 23-2 is charged in advance with 30% charge, while the other pressure rising units are charged in advance with 100% charge.

When the photography switch 9 is turned on under said conditions, it is determined whether or not the next fully charged pressure rising unit is present. In the example from FIG. 14, all pressure rising units excluding the pressure rising unit 23-2 are fully charged, so it is determined that the fully-charged pressure rising unit is present. Next, one pressure rising unit (the pressure rising unit 23-1 in the example from FIG. 14) is specified among the fully charged pressure rising units. Said specification is carried out by the switching instructions from the X-ray controller 7 to the input switching unit 20.

Next, the input switch corresponding to the specified fully charged pressure rising unit is turned on. In the example from FIG. 14, the input switch 21-1 corresponding to the specified fully charged pressure rising unit 23-1 is turned on. By turning on the input switch 21-1, switching processing of the fully charged pressure rising unit 23-1 is carried out in the input switching unit 20.

Next, the condenser configuring said specified pressure rising unit 23-1 is discharged. Said discharging is carried out by transmitting discharging instructions from the X-ray controller 7 to the pressure rising unit 23-1. Furthermore, the switching instructions and discharging instructions are generally simultaneously transmitted.

Due to discharging the condenser configuring the pressure rising unit 23-1, the high voltage direct current generated in the pressure rising unit 23-1 is supplied to the X-ray tube 3 at a specified time determined in advance and the high voltage X-rays from the X-ray tube 3 are irradiated onto the subject 50. When said specified time passes after commencing supply of the high voltage direct current to the X-ray tube 3, the high voltage X-ray photography using high voltage X-rays is terminated.

Next, a determination is made regarding whether or not the 30% charged pressure rising unit is present among the pressure rising units excluding the discharged pressure rising unit 23-1. In the example from FIG. 14, the pressure rising unit 23-2 is charged by 30%, so it is determined that a 30% charged pressure rising unit charged is present. Next, said pressure rising unit 23-2 is specified, and the input switch 21-2 corresponding to the specified pressure rising unit 23-2 is turned on. By turning on the input switch 21-2, switching processing of the specified 30% charged pressure rising unit 23-2 is carried out in the input switching unit 20.

Next, the condenser configuring said specified pressure rising unit 23-2 is discharged. Said discharging is carried out by transmitting discharging instructions from the X-ray controller 7 to the pressure rising unit 23-2.

Due to discharging the condenser configuring the pressure rising unit 23-2, the low voltage direct current generated in the pressure rising unit 23-2 is supplied to the X-ray tube 3 at a specified irradiation time determined in advance and the low voltage X-rays from the X-ray tube 3 are irradiated onto the subject 50. When said specified time passes after commencing supply of the low voltage direct current to the X-ray tube 3, the low voltage X-ray photography due to irradiating low voltage X-rays is terminated.

Furthermore, regarding the pressure rising unit 23-1 for high voltage X-ray irradiation, full charging is carried out again after discharging is completed, while regarding the pressure rising unit 23-2 for low voltage X-ray irradiation, charging is controlled such that 30% charging is carried out again after discharging has completed.

Therefore, according to the X-ray equipment related to said Modified Example 2, two X-ray types of different radiation dosages such as high voltage X-rays and low voltage X-rays may be successively irradiated within a short amount of time, so energy subtraction photography may be carried out in a short amount of time.

Furthermore, besides the example mentioned above of completely discharging the 100% charged condenser and the 30% charged condenser, for example, a control may be carried out wherein one among two 100%-charged condensers are completely discharged while the other is discharged by about 30%.

Embodiment 2

The X-ray equipment 200 related to Embodiment 2 is described as follows with reference to FIG. 15.

Furthermore, the difference in the X-ray equipment 200 between the present embodiment and the X-ray equipment 1 of Embodiment 1 is that a thermoelectricity converter 14 and a battery switching unit 60 are installed in addition to the processing content of the system controlling unit 6 being different. Therefore, the different parts are mainly described in the following.

Figure 15:
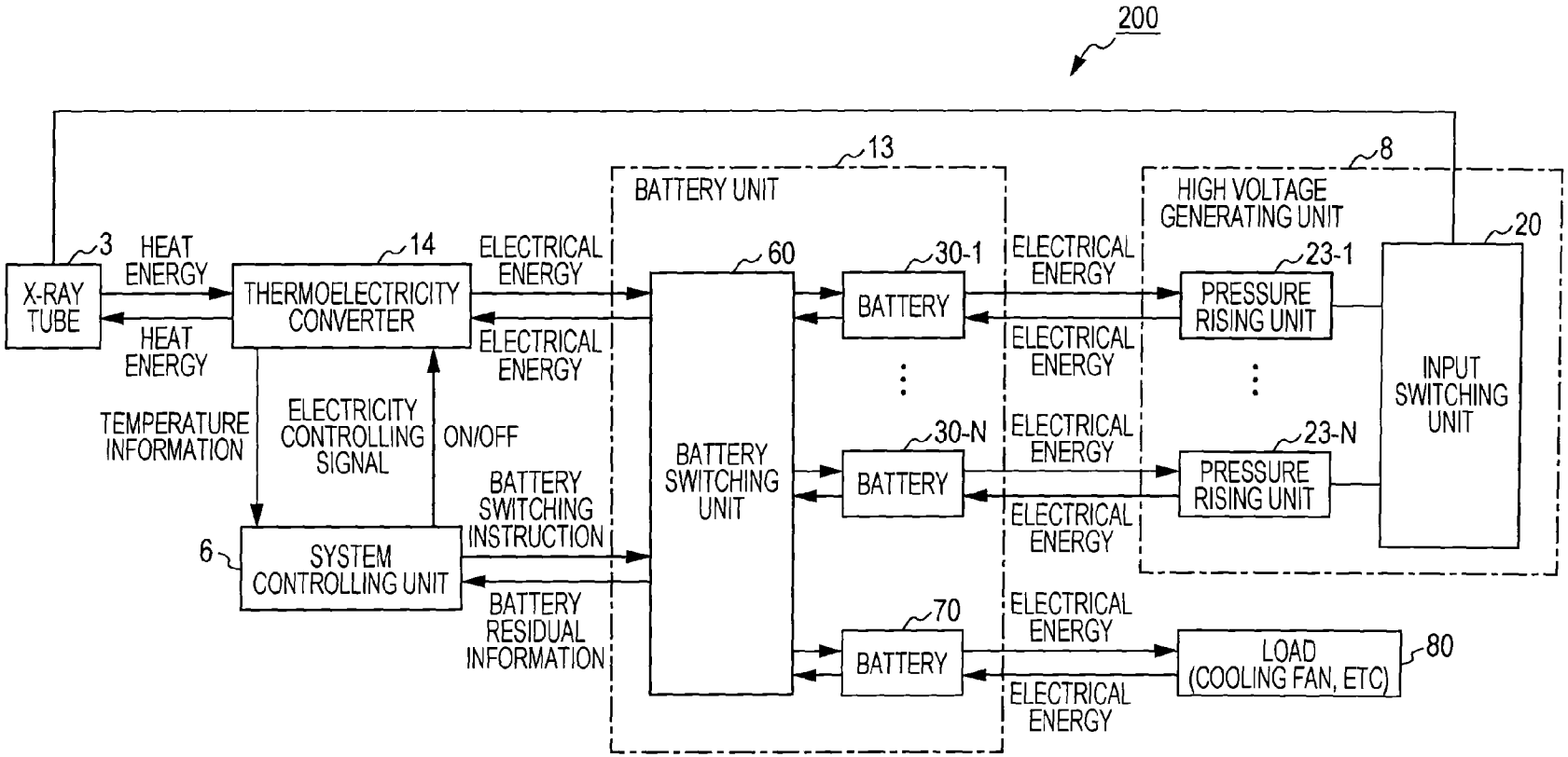
FIG. 15 is a schematic diagram showing an operation example of the X-ray equipment of Embodiment 2.

As shown in FIG. 15, the X-ray equipment 200 comprises a thermoelectricity converter 14 that converts heat energy generated when voltage is supplied to the X-ray tube 3 into electrical energy, as well as a battery switching unit 60. The thermoelectricity converter 14 includes a function of collecting heat energy generated when high voltage direct current is supplied to the X-ray tube 3 and converting this into electrical energy (direct-current power).

[Thermoelectricity Converter]

Specifically, the thermoelectricity converter 14 is configured from a thermoelectric transducer (not illustrated), a voltage converting circuit (for example, DC-DC converter: not illustrated) that converts the direct flow output from said thermoelectric transducer to a desired high voltage direct current (for example, DC-DC converter: not illustrated), and a temperature sensor (for example, a temperature sensor: not illustrated) that detects the temperature near the X-ray tube 3. Said thermoelectric transducer is an element that converts heat into electricity due to the Seebeck effect and is adhered to the X-ray tube 3 via connecting materials with good heat conductivity. Moreover, the thermoelectricity converter 14 is connected to the batteries 30-1 to 30-N (battery system related to X-ray generation) and battery 70 (battery system used for purposes other than X-ray generation) via the battery switching unit 60.

Moreover, the thermoelectricity converter 14 is connected to a system controlling unit 6 that transmits temperature information near the X-ray tube 3 detected by a temperature sensor to said system controlling unit 6. The temperature information is necessary because electromotive force due to the Seebeck effect will not occur there unless the specified temperature difference occurs between the thermoelectric transducers.

[Battery Unit]

The battery unit 13 is configured from the batteries 30-1 to 30-N and the battery switching unit 60. The battery switching unit 60 receives battery switching instructions, which are mentioned later, from the system controlling unit 6, specifies the battery that receives electrical energy from the thermoelectricity converter 14, and carries out a process of switching over to this. Said switching processing is carried out by turning on and off the switching switch (not illustrated) provided inside in correspondence with the battery. Furthermore, a semiconductor switch is an example of the switching switch.

[System Controlling Unit]

The system controlling unit 6 receives temperature information from said temperature sensor and transmits electricity controlling signals (on-signal/off-signal) for energizing/de-energizing the thermoelectric transducer. The system controlling unit 6 transmits electricity controlling signals (on-signal) for energizing the thermoelectric transducer to the thermoelectricity converter 14 when the temperature information exceeds the specified threshold and transmits electricity controlling signals (off-signal) for de-energizing to the thermoelectricity converter 14 when the temperature information is less than said specified threshold. Furthermore, said threshold is set in advance to a lower limit, allowing for conversion of heat energy to electrical energy by the thermoelectric transducer.

Moreover, the system controlling unit 6 transmits the battery switching instructions for specifying (selecting) the battery as the target for supplying electrical energy from among the batteries 30-1 to 30-N and battery 70 at the same time as transmitting the electricity controlling signals (on-signal) for energizing the thermoelectric transducer. Then, from the thermoelectricity converter 14 that received the electricity controlling signals (on-signal), the converted electric energy is supplied to the specified and switched over battery.

Here, the timing for transmitting battery switching instructions differs depending on the presence of the verification mode. Here, the verification mode refers to the mode in which the patient is currently carrying out X-ray photography. For example, the X-ray photography of the patient is given priority during the verification mode, so discontinuation of the X-ray photography caused by battery shortage during photography should be avoided.

Accordingly, the system controlling unit 6 transmits battery switching instructions so as to specify the battery system related to X-ray generation, that is, the batteries 30-1 to 30-N connected to the pressure rising unit, during the investigation mode (for example, when investigation mode signals is received from the outside to the effect that it is during the investigation mode).

Meanwhile, when it is a mode other than the verification mode, it is not connected to the battery system used for purposes other than X-ray generation; that is, it is not connected to the pressure rising unit, and battery switching instructions are transmitted such that the battery 70 connected to other loads 80 (for example, cooling fan, etc.) is specified.

Other than the technique mentioned above, residual battery information of the batteries 30-1 to 30-N and battery 70 may be transmitted to the system controlling unit 6 at fixed intervals and when the residual battery (amount of charge) of batteries 30-1 to 30-N falls below the threshold of the specified residual, transmitting battery switching instructions.

As described above, according to the present Embodiment 2, heat energy that was wastefully discarded as heat may be effectively used as electrical energy. Moreover, in a verification mode in which X-ray photography is carried out, electrical energy is preferentially supplied to a battery with less residual battery from among the battery systems related to X-ray generation; therefore, the time of use of the X-ray equipment for consultation (radiography time) that uses batteries in particular may be extended.

The embodiment of the present invention was described; however, the embodiments mentioned above were presented as examples and are not intended to limit the range of the present invention. Said new embodiments may be carried out in various other forms, and various abbreviations, substitutions, and changes may be carried out within a range not deviating from the spirit of the invention. Said embodiments and modifications thereof are included in the range and spirit of the invention as well as inventions presented in the range of the patent claims and the equivalent thereof.

While certain embodiments have been described, these embodiments have been presented by way of example only, and are not intended to limit the scope of the inventions. Indeed, the novel systems described herein may be embodied in a variety of their forms; furthermore, various omissions, substitutions and changes in the form of the systems described herein may be made without departing from the spirit of the inventions. The accompanying claims and their equivalents are intended to cover such forms or modifications as would fall within the scope and spirit of the inventions.

What is claimed is:

1. X-ray equipment comprising:

a plurality of pressure rising units that are connected to a battery unit and generate direct current voltage, each of the pressure rising units including a condenser;

a switching unit that switches over said plurality of pressure rising units and supplies said direct current voltage to a X-ray generating unit; and a switching control unit that transmits switching instructions to said switching unit for switching over said pressure rising units after receiving voltage supply instructions with respect to the X-ray generating unit until said voltage supply instructions terminate, wherein said switching control unit controls the commencing of charging of a condenser that has been discharged to less than a predetermined value in the pressure rising units in parallel to controlling the discharge of a condenser that has been charged to more than the predetermined value inside the pressure rising units by said switching instructions; and an X-ray tube that generates X-rays; and a thermoelectricity converter that converts heat energy of the X-ray tube into electrical energy, wherein said switching control unit uses the electrical energy converted by the thermoelectricy converter for charging of the discharged condenser.

2. The X-ray equipment according to claim 1, wherein;

when there is more than one charged condenser, said switching control unit decides an order of discharging the plurality of the charged condenser, and when there is more than one discharged condenser, said switching control unit decides an order of charging the plurality of the discharged condenser.

3. The X-ray equipment according to claim 2, wherein;

said switching control unit confirms the state-of-charge of the condenser per the pressure rising units, and detects the charged condenser and the discharged condenser.

4. The X-ray equipment according to claim 1, wherein;

said switching control unit changes charge amount of the discharged condenser per the pressure rising unit.

5. The X-ray equipment according to claim 1, wherein;

said switching control unit changes discharge amount of the charged condenser per the pressure rising unit.

6. The X-ray equipment according to claim 1, further comprising; a temperature sensor that detects temperature near the X-ray tube, wherein said switching control unit uses the electrical energy converted by the thermoelectricity converter for charging of the discharged condenser depending on the temperature detected by the temperature sensor.

* * * * *